US005375424A

United States Patent [19]

Bartlett et al.

[11] Patent Number: 5,375,424

[45] Date of Patent: Dec. 27, 1994

[54] CRYOPUMP WITH ELECTRONICALLY CONTROLLED REGENERATION

[75] Inventors: Allen J. Bartlett, Milford; Stephen J. Yamartino, Wayland, both of Mass.

[73] Assignee: Helix Technology Corporation, Mansfield, Mass.

[21] Appl. No.: 23,697

[22] Filed: Feb. 26, 1993

[51] Int. Cl.[5] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 4,555,907 | 12/1985 | Bartlett | 62/55.5 |
| 4,757,689 | 7/1988 | Bachler et al. | 62/55.5 |
| 4,918,930 | 4/1990 | Gaudet et al. | 62/55.5 |
| 5,111,667 | 5/1992 | Hafner et al. | 62/55.5 |
| 5,176,004 | 1/1993 | Gaudet | 62/55.5 |

FOREIGN PATENT DOCUMENTS

| | | |
|---|---|---|
| 0445503 | 11/1991 | European Pat. Off. . |
| 2599789 | 11/1987 | France . |

OTHER PUBLICATIONS

Mundinger, H. J. et al, "A new cryopump with a very fast regeneration system," *Vacuum*, vol. 43, Nos. 5–7, pp. 545–549, 1992.

*Primary Examiner*—Ronald C. Capossela

*Attorney, Agent, or Firm*—Hamilton, Brook, Smith & Reynolds

[57] ABSTRACT

In a fast partial regeneration process, the second stage of a cryopump is heated as purge gas is applied to the cryopump. In a test loop, the purge gas is turned off and the roughing valve is opened. If the cryopump is judged to be sufficiently empty of gases from the second stage by being roughed to a sufficiently low pressure in a short period of time the system proceeds to a reconditioning phase. If the system fails the test, however, it is repurged with a burst of warm purge gas and then retested. After passing the emptiness test, the pressure is further reduced by the roughing pump as heat is applied to the second stage. The heat is then turned off for cool down as the system continues to be rough pumped to a base pressure. At about the base pressure, the roughing valve is cycled to maintain the cryopump pressure at a level near to the base pressure. Where multiple cryopumps are coupled to a common roughing pump manifold, they are processed through a partial regeneration sequence in lock step to avoid cross contamination.

34 Claims, 5 Drawing Sheets

CRYOPUMP WITH ELECTRONICALLY CONTROLLED REGENERATION

BACKGROUND OF THE INVENTION

Cryogenic vacuum pumps, or cryopumps, currently available generally follow a common design concept. A low temperature array, usually operating in the range of 4° to 25° K., is the primary pumping surface. This surface is surrounded by a higher temperature radiation shield, usually operated in the temperature range of 60° to 130° K., which provides radiation shielding to the lower temperature array. The radiation shield generally comprises a housing which is closed except a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate of cup or an array of metal baffles arranged around and connected to the second-stage heat sink. This second-stage cryopanel also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink through the side shield or, as disclosed in U.S. Pat. No. 4,356,810, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases for the system. As the gases evaporate, the pressure in the cryopump increases, and the gases are exhausted through a relief valve. During regeneration, the cryopump is often purged with warm nitrogen gas. The nitrogen-gas hastens warming of the cryopanels and also serves to flush water and other vapors from the cryopump. Nitrogen is the usual purge gas because it is relatively inert, and is available free of water vapor. It is usually delivered from a nitrogen storage bottle through a fluid line and a purge valve coupled to the cryopump.

After the cryopump is purged, it must be rough pumped to produce a vacuum about the cryopumping surfaces and cold finger which reduces heat transfer by gas conduction and thus enables the cryocooler to cool to normal operating temperatures. The roughing pump is generally a mechanical pump coupled through a fluid line to a roughing valve mounted to the cryopump.

The typical regeneration process takes several hours during which the manufacturing or other process for which the cryopump creates a vacuum must idle. In most systems, it is only the second stage which requires regeneration. Therefore, partial regeneration processes have been used in which the second stage is warmed to release gases from only that stage as the refrigerator continues to operate to prevent release of gases from the first stage. It is critical that gas not be released from the first stage because that gas would contaminate the warm second stage, and such contamination would require that the cryopump be put through a full regeneration cycle. Since the refrigerator continues to operate and the cryopanels remain at relatively cool temperatures, the cool down time after the partial regeneration process is significantly less than that of a full regeneration.

Control of the regeneration process is facilitated by temperature gauges coupled to the cold finger heat stations. Thermocouple pressure gauges have also been used with cryopumps. Although regeneration may be controlled by manually turning the cryocooler off and on and manually controlling the purge and roughing valves, a separate regeneration controller is used in more sophisticated systems. Leads from the controller are coupled to each of the sensors, the cryocooler motor and the valves to be actuated. A cryopump having an integral electronic controller is presented in U.S. Pat. No. 4,918,930.

DISCLOSURE OF THE INVENTION

The present invention relates to a method of regeneration of a cryopump, and particularly partial regeneration, and the electronics for controlling that regeneration process. A cryopump has at least first and second stages in a cryopump chamber. The stages are cooled by a cryogenic refrigerator, and there is an adsorbent on the second, colder stage. The second stage is heated by a heating element during the partial regeneration process. Warm [,urge gas may be applied to the cryopump chamber through a purge valve. The cryopump chamber is initially pumped down by a roughing pump through a roughing valve.

In the preferred partial regeneration method of the present invention, the second stage of the cryopump is heated and purge gas is applied to the cryopump chamber to release gases from the second stage. To avoid overheating of the cryopump which would cause release of gases from the first stage, yet to assure that the second stage is fully regenerated, the system cycles between application of bursts of purge gas to the cryopump and opening of the roughing valve from the cryopump. The system cycles between purging and roughing until the cryopump is determined to be sufficiently empty of condensed and adsorbed gases from the second stage. Preferably, the second stage is determined to be empty by monitoring the pressure of the cryopump during roughing and determining whether the pressure of the cryopump drops to a predetermined level such as about 1,000 microns during a roughing time. If the cryopump fails to reach that level, the system again cycles through the purging and roughing process.

Once the cryopump is determined to be sufficiently empty in the prior step, the roughing valve is kept open to further reduce the pressure. It is preferred that the second stage heating continue to maintain a temperature of between 175 K and 200 K to further remove any gases from the adsorbent. Once the pressure is reduced to a predetermined level, the heating element is turned off while roughing continues.

As the system cools, the roughing valve is closed when the pressure is further reduced to a base pressure level. Once the cryopump is sufficiently cold, it will continue to draw the pressure down with condensation and adsorption of gases on the cryopanel. However, initially after closing of the roughing valve, outgasing in the cryopump results in a pressure increase. In accordance with another aspect of the present invention, as the cryopump cools the roughing valve is cyclically opened and closed to maintain the pressure of the cryopump near to the base pressure level. Preferably, the base pressure level is within the range of about 25 to 250 microns. For example, the roughing valve may cycle to maintain the pressure between 50 and 60 microns until the cryopanels reduce the pressure below 50 microns.

A plurality of cryopumps may be coupled through respective rouging valves to a common roughing pump. In that case, for fast regeneration of all cryopumps, the cryopumps are caused to open their respective roughing valves to the roughing pump together. Through a regeneration cycle, the cryopumps maintain near equal pressures while respective roughing valves are open.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENT

Figure 1:
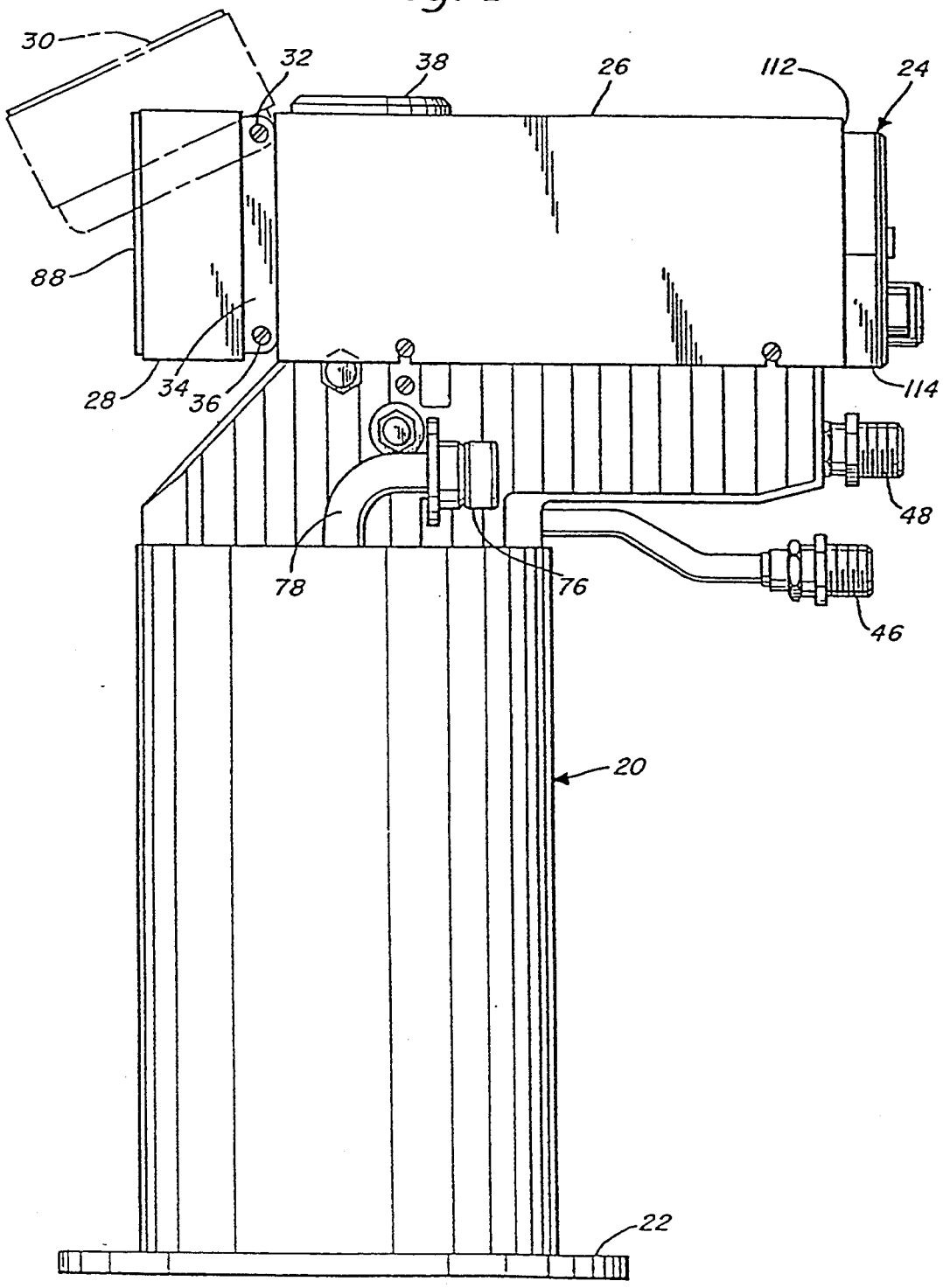
FIG. 1 is a side view of a cryopump embodying the present invention.

FIG. 1 is an illustration of a cryopump embodying the present invention. The cryopump includes the usual vacuum vessel 20 which has a flange 22 to mount the pump to a system to be evacuated. In accordance with the present invention, the cryopump includes an electronic module 24 in a housing 26 at one end of the vessel 20. A control pad 28 is pivotally mounted to one end of the housing 26. As shown by broken lines 30, the control pad may be pivoted about a pin 32 to provide convenient viewing. The pad bracket 34 has additional holes 36 at the opposite end thereof so that the control pad can be inverted where the cryopump is to be mounted in an orientation inverted from that shown in FIG. 1. Also, an elastomeric foot 38 is provided on the flat upper surface of the electronics housing 26 to support the pump when inverted.

Figure 2:
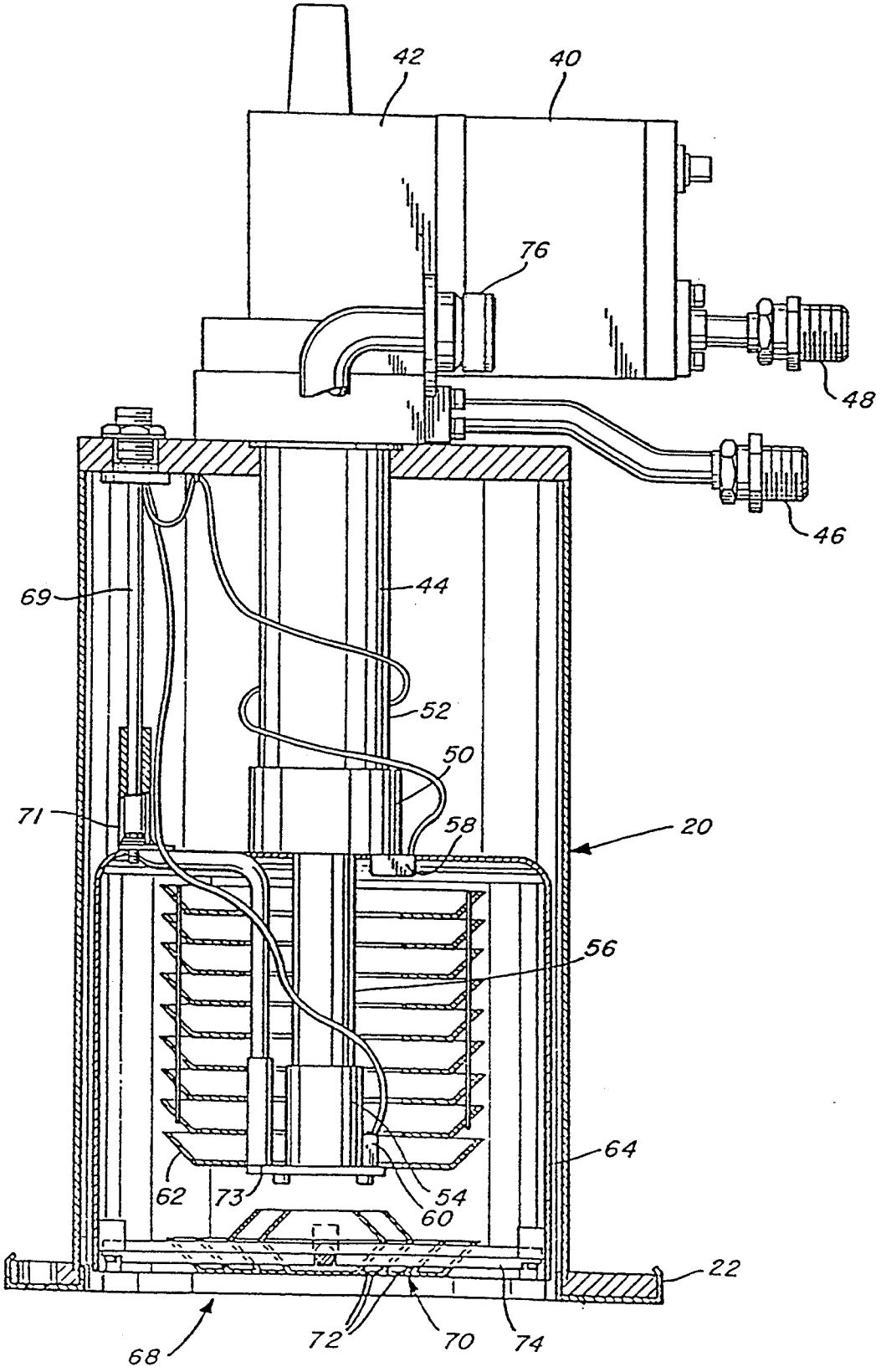
FIG. 2 is a cross-sectional view of the cryopump of FIG. 1 with the electronic module and housing removed.

As illustrated in FIG. 2, much of the cryopump is conventional. In FIG. 2, the housing 26 is removed to expose a drive motor 40 and a crosshead assembly 42. The crosshead converts the rotary motion of the motor 40 to reciprocating motion to drive a displacer within the two-stage cold finger 44. With each cycle, helium gas introduced into the cold finger under pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat sink 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield. This radiation shield 64 surrounds the primary cryopanel array to the rear and sides to minimize heating of the primary cryopanel array be radiation. The temperature of the radiation shield may range from as low as 40° K. at the heat sink 50 to as high as 130° K. adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but is should be so arranged as to act as a radiant heat shield and a higher temperature cryopumping panel while providing a path for lower boiling temperature gases to the primary cryopanel.

Figure 3:
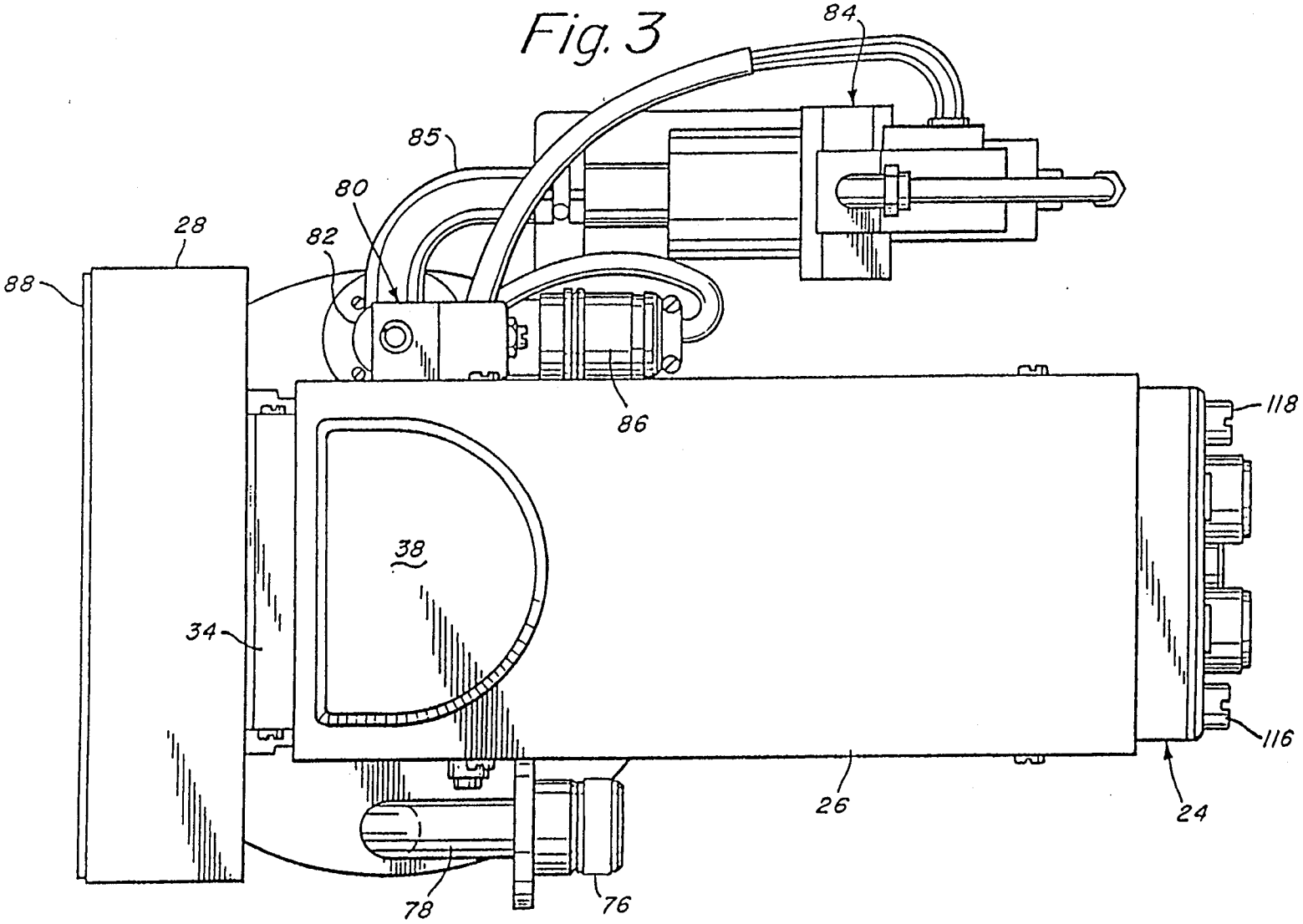
FIG. 3 is a top view of the cryopump of FIG. 1.

As illustrated in FIGS. 1 and 3, a pressure relief valve 76 is coupled to the vacuum vessel 20 through an elbow 78. To the other side of the motor and the electronics housing 26, as illustrated in FIG. 3, is an electrically actuated purge valve 80 mounted to the housing 20 through a vertical pipe 82. Also coupled to the housing 20 through the pipe 82 is an electrically actuated roughing valve 84. The valve 84 is coupled to the pipe 82 through an elbow 85. Finally, a thermocouple vacuum pressure gauge 86 is coupled to the interior of the chamber 20 through the pipe 82.

Less conventional in the cryopump is a heater assembly 69 illustrated in FIG. 2. The heater assembly includes a tube which hermetically seals electric heating units. The heating units heat the first stage through a heater mount 71 and a second stage through a heater mount 73.

The refrigerator motor 40, cryopanel heater assembly 69, purge valve 80 and roughing valve 84 are all controlled by the electronic module. Also, the module monitors the temperature detected by temperature sensors 58 and 60 and the pressure sensed by the TC pressure gauge 86.

Figure 4:
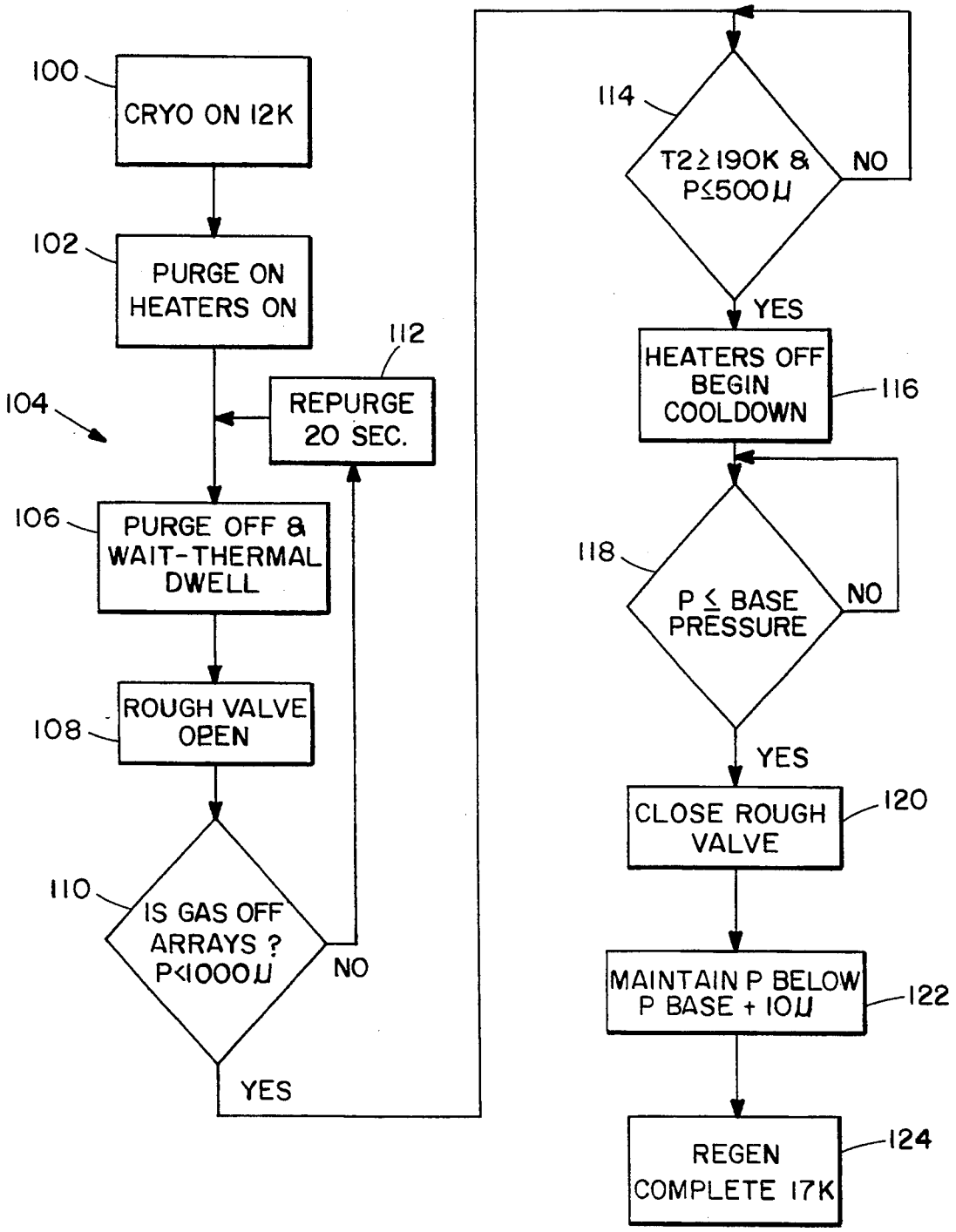
FIG. 4 is a flow chart of a partial regeneration procedure programmed into the electronic module.

To control a partial regeneration process, the electronic module is programmed as illustrated in FIG. 4. Initially, the cryopump is operating normally at state 100 with the second stage temperature of about 12 K. To initiate the partial regeneration procedure, the system opens the purge valve to introduce warm nitrogen purge gas and turns the heaters to the first and second stages on. The cryogenic refrigerator continues to operate but its cooling effect is partially overcome by the heat applied. The purge is maintained for an initial period of, for example, two minutes.

The first stage is warmed to and held at about 110 K to minimize collection of liquified gases thereon after the gases are released from the second stage. The first stage temperature is retained sufficiently low to avoid release of water vapor therefrom. The second stage temperature set point is set at a level between 175 K and 200 K. The second stage is heated to greater than 175 K and held there during roughing to minimize contamination of the adsorbent with gases such as nitrogen and argon. The second stage is held to less than 200 K to shorten the cool-down time. A preferred temperature set point is 190 K.

The first phase of the regeneration process is a loop 104 during which the second stage heater maintains the 190 K temperature, but the overall heat input is made periodic by pulsing of the purge gas. In order to accomplish the partial regeneration in the shortest possible time, the purge gas in only pulsed so many times as required to evolve the gas from the adsorbent. Thus, after each pulse, an emptiness test is performed with opening of the roughing valve. If the test is failed, an additional pulse of heat is applied to remove the remaining gas. Through this method, only enough heat in inputted and enough time spent to remove from the cryopump the amount of gas absorbed or condensed on the second stage. Depending on the amount of gases condensed or adsorbed on the second stage, the system will typically cycle one to six times before passing the emptiness test.

More specifically, in the loop 104 the purge is turned off at 106. The system then dwells for about 60 seconds in order to allow for further heating of the second stage through conduction. Then, at 108 the roughing valve is opened to evacuate the cryopump chamber. When the roughing valve is open, the system checks at 110 to determine whether the pressure has dropped to less than 1,000 microns during a roughing time of about 150 seconds. If the materials remain adsorbed or condensed on the second stage array the gases continue to evolve from the heated second stage and prevent rapid pressure reduction with rough pumping.

Further, even if all material has been released from the second stage, it may pool in liquid form on the first stage or even on the cryopump vessel. Continued heating of the second stage array will not greatly affect the evaporation of those liquids, yet the presence of the liquids will retard rough pumping. In fact, with opening of the roughing valve, the quick drop in pressure may cause refreezing of the cooled liquid, substantially increasing the time which would be required for the roughing pump to cause sublimation or evaporation to reduce the pressure.

If liquid or solid from the second stage array remains on the second stage or pooled anywhere in the cryopump, roughing will hang up at a pressure plateau. The level of that plateau depends on the fluid involved and may be several times higher than the 1,000 micron test level. However, the thousand micron level is clearly below any plateau that would be experienced and should be reached within 150 seconds of roughing if the cryopump is sufficiently empty.

If at 110 the pressure has not dropped to 1,000 microns it is determined that the cryopump is not sufficiently empty. The roughing valve is closed at 112, and the purge valve is opened for 20 seconds. The introduction of the purge gas at about atmospheric pressure facilitates prompt evaporation of any pooled liquid as well as further release of condensed and adsorbed gases. After that burst of purge gas, the system recycles through the thermal dwell at 106 and opening of the roughing valve at 108 with the emptiness test at 110.

Once the system passes the emptiness test at 110, the roughing valve is left open with no further purging. Heat continues to be applied to the second stage to maintain the temperature of the second stage at 190 K. This reconditioning phase of the partial regeneration process continues until the second stage is heated to 190 K and the pressure is reduced to 500 microns as indicated by the check 114. Once those limits are reached, the heaters are turned off at 116 with the roughing valve left open. With the cryopanels now cooling and the roughing valve evacuating, the system checks at 118 for a reduction in pressure to a base pressure such as 50 microns, preferably in the range of 25 to 250 microns. The roughing valve is then closed at 120.

The base pressure at which the roughing valve is closed is determined by the particular system. Generally, the pressure is reduced to as low a level as possible without risking contamination of the adsorbent by oil backstreaming from the roughing pump.

The temperature of the second stage may be maintained at 190 K until the pressure is reduced to the base pressure, but such an approach increases the cool-down time and thus the time of the overall partial regeneration process. It has been found that a reduction to only 500 microns before turning off the heaters is a good compromise. In fact, using the roughing procedure described, ten sequential partial regeneration procedures have been run without any change in hydrogen pumping capacity of the adsorbent.

Due to continued internal outgasing, the cryopump internal pressure rises even as the cryopump continues to cool down. That pressure slows recooling and may rise high enough to prevent the recooling of the cryopump. In order to prevent this increase in pressure due to outgasing, the roughing valve is cycled between limits near the base pressure at 122. Thus, when the pressure increases to 10 microns above the base pressure, the roughing valve is opened to draw the pressure back down to the base pressure. This keeps the pressure at an acceptable level and also provides further conditioning of the adsorbent by removal of additional gas. This approach of roughing valve cycling may also be applied to rough pumping after full regeneration.

Once the second stage temperature has reached 17 K, the partial regeneration procedure is complete at 124.

Figure 5:
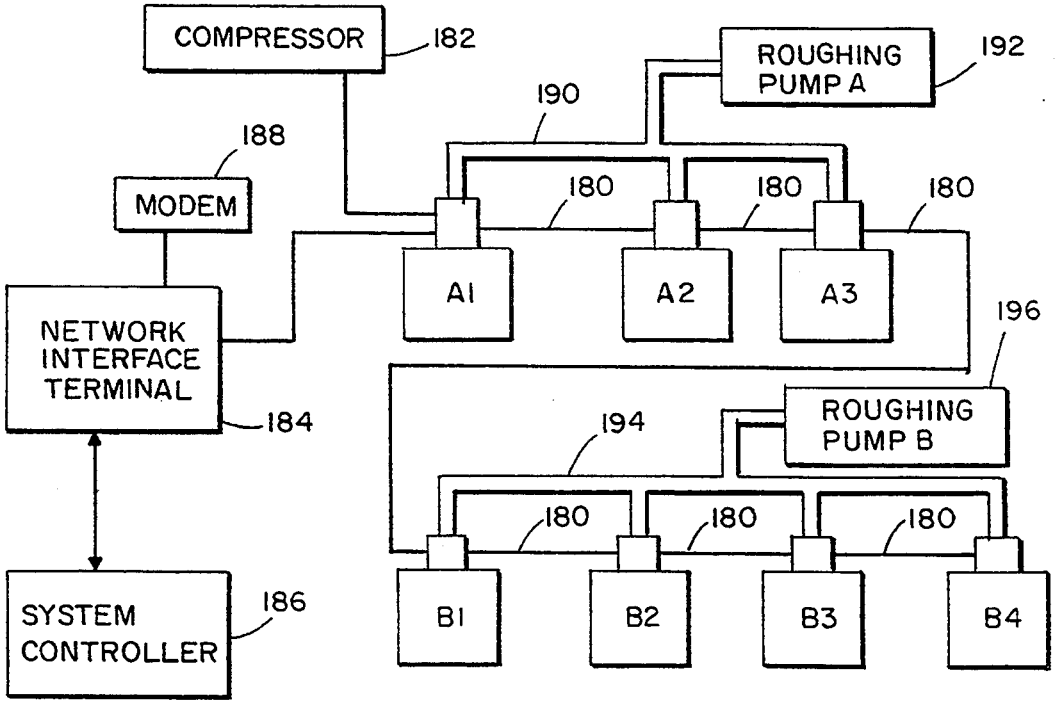
FIG. 5 is an illustration of a network with groups of cryopumps coupled to roughing pump manifolds.

FIG. 5 illustrates a network of cryopumps, each as thus far described. Included in the lines 180 joining the cryopumps are the helium lines and power lines for distributing helium and power from a compressor unit 182. Also included in the lines 180 are SDLC multidrop communications lines connecting the cryopumps through network communications ports.

All network communications are controlled by a network interface terminal which may communicate through an RS 232 port with a system controller 186. While the network interface terminal controls the many cryopumps, the system controller 185 would be responsible for all processing in, for example, a semiconductor fabrication system. The network interface terminal may also communicate with a host computer through a modem 188. Through either the modem 188 or the RS 232 port, the network interface terminal may be used to reconfigure any of the cryopumps connected in the network.

FIG. 5 illustrates seven cryopumps connected in two groups. Cryopumps A1, A2 and A3 are coupled through a manifold 190 to a common roughing pump 192. Cryopumps B1, B2, B3 and B4 are coupled through a manifold 194 to a common roughing pump 196. With connection of multiple cryopumps to a single roughing pump, it is important that no two roughing valves be opened to connect cryopumps at different pressures to a common roughing pump at one time. Otherwise, the vacuum obtained in one cryopump would be lost as a subsequent cryopump was coupled to the manifold 190, and cross-contamination would result.

In a control system presented in U.S. Pat. No. 5,176,004, the network interface terminal 184 allowed only one cryopump access to a roughing pump at a time. That prevented cross-contamination of cryopumps, but a disadvantage of that approach is that it does not provide the most rapid regeneration of plural pumps since the pumps cannot be rough pumped simultaneously.

In accordance with the present invention, the several cryopumps are allowed to open their roughing valves simultaneously. However, to avoid cross-contamination the network interface terminal 184 assures that all cryopumps are in the same phase of the regeneration process. Thus, all cryopumps are directed to begin the partial regeneration process at the same time so that the roughing valves open simultaneously at 108 during the initial phase of regeneration. Because the cryopumps are all operating in synchronization, each will initially be at about atmospheric pressure when the roughing valves open and the roughing pump will draw the three pumps down simultaneously. With all pumps at about the same pressure, there will be no cross-contamination. The number of times that the system then continues through the loop 104 is determined by the cryopump which requires the most purge cycles. All cryopumps coupled to a common manifold are repurged and roughed until all pass the emptiness test at 110. Thereafter, until the closing of the roughing valves at 120, all of the cryopumps connected to the manifold continue to stay at the same pressure.

During the cycling of the roughing valve at 122 to maintain the pressure at about the base pressure, the roughing valves are not held in lock step. Any valves which open during this period open to chambers which are within 10 microns of each other. A 10 micron pressure differential does not present a cross-contamination concern as the roughing pump continues to draw.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of partial regeneration of a cryopump having at least first and second stages comprising:

heating the second stage of the cryopump;

cycling between application of purge gas to the cryopump and opening of a roughing valve from the cryopump until the cryopump is sufficiently empty of gases condensed and adsorbed on the second stage;

maintaining the roughing valve open to reduce pressure of the cryopump while continuing heating of the second stage;

stopping heating of the second stage and continuing rough pumping of the cryopump with the roughing valve open to further reduce pressure of the cryopump;

closing the roughing valve at a base pressure level; and cyclically opening and closing the roughing valve as the cryopump cools to maintain the pressure of the cryopump near to the base pressure level.

2. A method as claimed in claim 1 wherein the second stage is heated to a temperature greater than 175 K while the roughing valve is open.

3. A method as claimed in claim 1 further comprising, in the step of cycling between purge and roughing, monitoring the pressure of the cryopump to determine that the second stage is sufficiently clean when the pressure drops a predetermined amount per roughing time.

4. A method as claimed in claim 1 in a system comprising a plurality of cryopumps coupled through respective roughing valves to a common roughing pump, the method comprising causing the cryopumps to open roughing valves to the roughing pump together such that the cryopumps maintain near equal pressures while the roughing valves are open.

5. A method of partial regeneration of a cryopump having at least first and second stages comprising:

heating the second stage of the cryopump; and cycling between a) opening a purge valve to apply warm purge gas to the cryopump with a roughing valve closed, and b) opening of the roughing valve from the cryopump with the purge valve closed until the cryopump is sufficiently empty of gases condensed and adsorbed on the second stage.

6. A method as claimed in claim 5 further comprising, in the step of cycling between purge and roughing, monitoring the pressure of the cryopump to determine that the cryopump is sufficiently empty when the pressure drops a predetermined amount per roughing time.

7. A method as recited in claim 5 wherein application of warm purge gas and opening of the roughing valve is cycled until pressure of the cryopump drops to a pressure level of about 1,000 microns within a predetermined amount of roughing time.

8. A method as claimed in claim 5 in a system comprising a plurality of cryopumps coupled through respective roughing valves to a common roughing pump, the method comprising causing the cryopumps to open roughing valves to the roughing pump together such that the cryopumps maintain near equal pressures while the roughing valves are open.

9. A method of regeneration of a cryopump comprising:

warming the cryopump to release gases from the cryopump;

rough pumping the cryopump through a roughing valve to bring pressure of the cryopump to a base pressure level and then closing the roughing valve; and cyclically opening and closing the roughing valve as the cryopump cools to maintain the pressure of the cryopump near to the base pressure level.

10. A method as recited in claim 9 wherein the base pressure level is in the range of about 25 to 250 microns.

11. A method of partial regeneration of a cryopump, the cryopump having at least first and second stages in a cryopump chamber cooled by a cryogenic refrigerator, there being an adsorbent on the second, colder stage, a second stage heating element for heating the second stage, a warm purge gas source for applying purge gas to the cryopump chamber and a roughing valve for coupling the cryopump chamber to a roughing pump, the method comprising, while continuing operation of the cryogenic refrigerator:

a) heating the second stage with the heating element while applying purge gas to the cryopump chamber;

b) disabling the purge gas while continuing to heat the second stage through a dwell time;

c) opening the roughing valve for a predetermined period of time;

d) if pressure in the cryopump has not been reduced to a first predetermined pressure level, closing the roughing valve and applying a burst of purge gas to the cryopump chamber, and cycling through steps b, c and d until the pressure is reduced to the first predetermined level;

e) continuing heating of the second stage with the roughing valve open to bring the temperature of the second stage up to a predetermined temperature level and the pressure of the cryopump chamber down to a second predetermined pressure level;

f) turning the second stage heating element off;

g) closing the roughing valve when the pressure in the cryopump chamber drops to a base pressure level; and h) as the second stage cools, monitoring pressure of the cryopump chamber and cyclically opening and closing the roughing valve to maintain the pressure below a near to the base pressure level.

12. A method as claimed in claim 11 wherein the second stage is heated to a temperature greater than 175 K while the roughing valve is open.

13. A method as claimed in claim 11 in a system comprising a plurality of cryopumps coupled through respective roughing valves to a common roughing pump, the method comprising causing the cryopumps to open roughing valves to the roughing pump together such that the cryopumps maintain near equal pressures while the roughing valves are open.

14. A cryopump comprising:

at least first and second stages in a cryopump chamber cooled by a cryogenic refrigerator, with an adsorbent on the second colder stage;

a second stage heating element for heating the second stage;

a warm purge gas valve for applying purge gas to the cryopump chamber;

a roughing valve for coupling the cryopump chamber to a roughing pump; and an electronic controller for controlling the heating element, purge gas valve and roughing valve, the controller being programmed to control a partial regeneration process while continuing operation of the cryogenic refrigerator by:

heating the second stage of the cryopump;

cycling between application of purge gas to the cryopump and opening of a roughing valve from the cryopump until the cryopump is sufficiently empty of gases condensed and adsorbed on the second stage, maintaining the roughing pump open to reduce pressure of the cryopump while continuing heating of the second stage;

stopping heating of the second stage and continuing rough pumping of the cryopump with the roughing valve open to further reduce pressure of the cryopump;

closing the roughing valve at a base pressure level; and cyclically opening and closing the roughing valve as the cryopump cools down to maintain the pressure of the cryopump near to the base pressure level.

15. A cryopump as claimed in claim 14 wherein the second stage is heated to a temperature greater than 175 K while the roughing valve is open.

16. A cryopump as claimed in claim 14 wherein the controller monitors the pressure of the cryopump to determine that the cryopump is sufficiently empty when the pressure drops a predetermined amount per roughing time.

17. A cryopump comprising:

at least first and second stages in a cryopump chamber cooled by a cryogenic refrigerator, with an adsorbent on the second, colder stage;

a second stage heating element for heating the second stage;

a warm purge gas valve for applying purge gas to the cryopump chamber;

a roughing valve for coupling the cryopump chamber to a roughing pump; and an electronic controller for controlling the heating element, purge gas valve and roughing valve, the controller being programmed to control a partial regeneration process while continuing operation of the cryogenic refrigerator by:

heating the second stage of the cryopump;

cycling between application of purge gas to the cryopump and opening of a roughing valve from the cryopump until the cryopump is sufficiently empty of gases condensed and adsorbed on the second stage; and maintaining the roughing pump open to reduce pressure of the cryopump.

18. A cryopump as claimed in claim 17 wherein the controller monitors the pressure of the cryopump to determine that the cryopump is sufficiently empty when the pressure drops a predetermined amount per roughing time.

19. A cryopump as claimed in claim 17 wherein application of warm purge gas and opening of the roughing valve is cycled until pressure of the cryopump drops to a pressure level of about 1,000 microns within a predetermined amount of roughing time.

20. A cryopump comprising:

at least first and second stages in a cryopump chamber cooled by a cryogenic refrigerator, with an adsorbent on the second, colder stage;

a second stage heating element for heating the second stage;

a warm purge gas valve for applying purge gas to the cryopump chamber;

a roughing valve for coupling the cryopump chamber to a roughing pump; and an electronic controller for controlling the heating element, purge gas valve and roughing valve, the controller being programmed to control a regeneration process by:

warming the cryopump to release gases from the cryopump;

rough pumping the cryopump through a roughing valve to bring pressure of the cryopump to a base pressure level and then closing the roughing valve; and cyclically opening and closing the roughing valve as the cryopump cools to maintain the pressure of the cryopump near to the base pressure level.

21. A cryopump as claimed in claim 20 wherein the base pressure level is in the range of about 25 to 250 microns.

22. A cryopump comprising:

at least first and second stages in a cryopump chamber cooled by a cryogenic refrigerator, with an adsorbent on the second, colder stage;

a second stage heating element for heating the second stage;

a warm purge gas valve for applying purge gas to the cryopump chamber;

a roughing valve for coupling the cryopump chamber to a roughing pump; and an electronic controller for controlling the heating element, purge gas valve and roughing valve, the controller being programmed to control a partial regeneration process while continuing operation of the cryogenic refrigerator by:

a) heating the second stage with the heating element while applying purge gas to the cryopump chamber;

b) disabling the purge gas while continuing to heat the second stage through a dwell time;

c) opening the roughing valve for a predetermined period of time;

d) if pressure in the cryopump has not been reduced to a first predetermined pressure level, closing the roughing valve and applying a burst of purge gas to the cryopump chamber and cycling through steps b, c and d until the pressure is reduced to the first predetermined level;

e) continuing heating of the second stage with the roughing valve open to bring the temperature of the second stage up to a predetermined temperature level and the pressure of the cryopump chamber down to a second predetermined pressure level;

f) turning the second stage heating element off;

g) closing the roughing valve when the pressure in the cryopump chamber drops to a base pressure level; and h) as the second stage cools, monitoring pressure of the cryopump chamber and cyclically opening and closing the roughing valve to maintain the pressure below a near to the base pressure level.

23. A cryopump as claimed in claim 22 wherein the second stage is heated to a temperature greater than 175 K while the roughing valve is open.

24. An electronic controller for controlling a cryopump, the controller including electronics programmed to control a cryopump second stage heating element, purge gas valve, and roughing valve in a partial regeneration process while continuing operation of the cryogenic refrigerator, the programmed electronics comprising:

means for heating the second stage of the cryopump;

means for cycling between application of purge gas to the cryopump and opening of a roughing valve from the cryopump until the cryopump is sufficiently empty of condensed and adsorbed gases from the second stage;

means for maintaining the roughing valve open to reduce pressure of the cryopump while continuing heating of the second stage;

means for stopping heating of the second stage and continuing rough pumping of the cryopump with the roughing valve open to further reduce pressure of the cryopump;

means for closing the roughing valve at a base pressure; and means for cyclically opening and closing the roughing valve as the cryopump cools to maintain the pressure of the cryopump near to the base pressure level.

25. An electronic controller as claimed in claim 24 wherein the second stage is heated to a temperature greater than 175 K while the roughing valve is open.

26. An electronic controller as claimed in claim 24 wherein the controller monitors the pressure of the cryopump to determine that the cryopump is sufficiently empty when the pressure drops a predetermined amount for roughing time.

27. An electronic controller for controlling a cryopump, the controller including electronics programmed to control a cryopump second stage heating element, purge gas valve, and roughing valve in a partial regeneration process while continuing operation of the cryogenic refrigerator, the programmed electronics comprising:

means for heating the second stage of the cryopump; and means for cycling between application of warm purge gas to the cryopump and opening of a roughing valve from the cryopump until the cryopump is sufficiently empty of condensed and adsorbed gases.

28. An electronic controller as claimed in claim 27 wherein the controller monitors the pressure of the cryopump to determine that the cryopump is sufficiently empty when the pressure drops a predetermined amount per roughing time.

29. An electronic controller as claimed in claim 27 wherein application of warm purge gas and opening of the roughing valve is cycled until pressure of the cryopump drops to a pressure level of about 1,000 microns within a predetermined amount of roughing time.

30. An electronic controller for controlling a cryopump, the controller including electronics programmed to control a cryopump heating element, purge gas valve, and roughing valve in a regeneration process, the programmed electronics comprising:

means for heating the second stage of the cryopump to release gases from the second stage;

means for rough pumping the cryopump through the roughing valve to bring pressure of the cryopump to a base pressure level and then closing the roughing valve; and means for cyclically opening and closing the roughing valve as the cryopump cools to maintain the pressure of the cryopump near to the base pressure level.

31. An electronic controller as claimed in claim 30 wherein the base pressure level is in the range of about 25 to 250 microns.

32. An electronic controller for controlling a cryopump, the controller including electronics programmed to control a cryopump second stage heating element, purge gas valve, and roughing valve in a partial regeneration process while continuing operation of the cryogenic refrigerator the programmed electronics comprising:

a) means for heating the second stage with the heating element while applying purge gas to the cryopump chamber;

b) means for disabling the purge gas while continuing to heat the second stage through a dwell time;

c) means for opening the roughing valve for a predetermined period of time;

d) if pressure in the cryopump has not been reduced to a first predetermined pressure level, means for closing the roughing valve and applying a burst of purge gas to the cryopump chamber, and cycling through steps b, c and d until the pressure is reduced to the first predetermined level;

e) means for continuing heating of the second stage with the roughing valve open to bring the temperature of the second stage up to a predetermined temperature level and the pressure of the cryopump chamber down to a second predetermined pressure level;

f) means for turning the second stage heating element off;

g) means for closing the roughing valve when the pressure in the cryopump chamber drops to a base pressure level; and h) as the second stage cools, means for monitoring pressure of the cryopump chamber and cyclically opening and closing the roughing valve to maintain the pressure below or near to the base pressure level.

33. An electronic controller as claimed in claim 32 wherein the second stage is heated to a temperature greater than 175 K while the roughing valve is open.

34. A method of controlling cryopumps comprising:

providing a plurality of cryopumps, each with a respective roughing valve connected to a common roughing pump; and opening the roughing valves to the roughing pump simultaneously through a regeneration process such that the cryopumps maintain near equal pressure while respective roughing valves are open.

* * * * *